US008328520B2

(12) United States Patent
Boening et al.

(10) Patent No.: US 8,328,520 B2
(45) Date of Patent: Dec. 11, 2012

(54) TURBOCHARGER WITH SEPARATELY FORMED VANE LEVER STOPS

(75) Inventors: Ralf Boening, Reiffelbach (DE); Dietmar Metz, Meckenheim (DE)

(73) Assignee: BorgWarner Inc., Auburn Hills, MI (US)

( * ) Notice: Subject to any disclaimer, the term of this patent is extended or adjusted under 35 U.S.C. 154(b) by 704 days.

(21) Appl. No.: 12/300,260

(22) PCT Filed: May 16, 2007

(86) PCT No.: PCT/EP2007/004397

§ 371 (c)(1), (2), (4) Date: Feb. 2, 2009

(87) PCT Pub. No.: WO2007/134787

PCT Pub. Date: Nov. 29, 2007

(65) Prior Publication Data

US 2010/0014961 A1 Jan. 21, 2010

(30) Foreign Application Priority Data

May 19, 2006 (DE) ..... 10 2006 023 923

(51) Int. Cl.
*F01D 17/12* (2006.01)

(52) U.S. Cl. ..... 416/160

(58) Field of Classification Search ..... 415/148–167
See application file for complete search history.

(56) References Cited

U.S. PATENT DOCUMENTS 4,695,220 A * 9/1987 Dawson ..... 415/9
4,741,666 A 5/1988 Shimizu et al.
(Continued)

FOREIGN PATENT DOCUMENTS

DE 2455361 * 6/1975
(Continued)

OTHER PUBLICATIONS

Machine translation, Burmester, EP 1635041.*
(Continued)

*Primary Examiner* — Fernando L Toledo
*Assistant Examiner* — Victoria K Hall
(74) *Attorney, Agent, or Firm* — William G. Anderson; Stephan A. Pendorf; Patent Central LLC

(57) ABSTRACT

The invention relates to a turbocharger (1) having variable turbine geometry (VTG) having a turbine housing (2) with a supply duct (9) for exhaust gases; having a turbine rotor (4) which is rotatably mounted in the turbine housing (2); and having a guide grate (18) which surrounds the turbine rotor (4) radially at the outside, which guide grate (18) has a blade mounting ring (6) which has a plurality of guide blades (7) which in each case have a blade shaft (8) mounted in the blade mounting ring (6), which guide grate (18) has an adjusting ring (5) which is operatively connected to the guide blades (7) by means of associated blade levers (20) which are fastened to the blade shafts (8) at one of their ends, wherein each blade lever (20) has, at the other end, a lever head (23) which can be placed in engagement with an associated engagement recess (24) of the adjusting ring (5), and which guide grate (18) has a stop (25) at least for setting the minimum throughflow through the nozzle cross sections which are formed by the guide blades (7), wherein the stop (25) is embodied as a separate component which can be fixed in the guide grate (18).

8 Claims, 2 Drawing Sheets

U.S. PATENT DOCUMENTS

| | | | | |
|---|---|---|---|---|
| 5,000,659 | A * | 3/1991 | Catte et al. | 415/150 |
| 5,146,752 | A * | 9/1992 | Bruestle | 60/602 |
| 2002/0023438 | A1 * | 2/2002 | Schmidt et al. | 60/602 |
| 2002/0119041 | A1 | 8/2002 | Jinnai et al. | |
| 2005/0260067 | A1 * | 11/2005 | Parker et al. | 415/160 |

FOREIGN PATENT DOCUMENTS

| | | | |
|---|---|---|---|
| DE | 19731715 | * | 1/1998 |
| DE | 19731715 | A1 | 1/1998 |
| DE | 10035762 | A1 | 1/2002 |
| EP | 1304462 | A2 | 4/2003 |
| EP | 1564380 | * | 8/2005 |
| EP | 1564380 | A1 | 8/2005 |
| EP | 1635041 | * | 3/2006 |

OTHER PUBLICATIONS

Derwent Abstract, Hall, DE 2455361.*

* cited by examiner

TURBOCHARGER WITH SEPARATELY FORMED VANE LEVER STOPS

The invention relates to a turbocharger according to the preamble of claim 1.

Such a turbocharger is known from EP 1 564 380 A1. For avoiding a weakening of the adjusting ring, this publication proposes a stop which is connected in one piece to the adjusting ring.

As a result of the one-piece formation of the stop on the adjusting ring it is possible, however, in the case of the known turbocharger to aftermachine the projection of the stop after installation of the guide vane cascade only at relatively high cost, if at all, if for example a correction of the end positions of the guide vane cascade ought to be undertaken or has to be undertaken. Furthermore, the projection of the stop of the known turbocharger limits the end positions as a result of abutment on fastening rings of the adjusting levers on the vanes which also makes an accurate adjustment of the end positions more difficult, since for one thing the fastening rings of these vane adjusting levers are subjected to manufacturing tolerances and for another inaccuracies arise as a result of the positioning (spacing).

It is therefore an object of the present invention to create a turbocharger of a type which is disclosed in the preamble of claim 1 which enables a simplification of the installation of the guide vane cascade or of the diffuser, wherein at least one simple and accurate adjustment of the minimum throughflow is to be possible by means of the diffuser alone.

The achieving of this object is effected by means of the features of claim 1.

By the fact that the stop, by which at least an adjustment of the minimum throughflow through the nozzle cross sections which are formed by the guide vanes is possible, is formed as a separate component which can be fixed in the guide vane cascade, it is possible after installation of the guide vane cascade to aftermachine this stop in a simple mariner for precise adjustment of the required stop position, since it is not connected in one piece to the guide vane cascade. If the necessity arises of a readjustment of one of the two end positions of the guide vane cascade, either a stop component which is suitable for the desired end position can therefore be selected and installed in a simple way, or the stop component which is provided can be adjusted by aftermachining of the projection and then installed in the guide vane cascade. Therefore, it is possible to undertake an accurate end position setting in a purposeful manner which in the case of the generic-type turbocharger is problematical on account of the one-piece formation of the stop.

In principle it is possible to fix the stop both on the bearing ring which is fixed in the housing, or on the movable adjusting ring. Depending upon this the projection of the stop then interacts either with mating stop surfaces of the adjusting ring or with the fastening rings of the vane levers.

Furthermore, the advantage arises that the entire diffuser can be completely preassembled as a cartridge and the minimum throughflow adjusted before it is then installed in the turbine housing.

The adjustment of the minimum throughflow is therefore carried out independently of turbine housing and other components of the turbocharger, such as the bearing housing. Also, the duct position between bearing housing and turbine housing no longer has any influence on the minimum throughflow adjustment. Similarly wear of the adjusting lever and its action upon the adjusting ring does not have any effect upon the minimum throughflow volume.

It is furthermore conceivable, in the case of welding, to directly connect the vane shafts to the vane levers in the position which is required for the minimum flow adjustment and consequently to dispense with a subsequent adjusting process. In this way, the risk and the possibility of a minimum flow change is excluded.

The dependent claims have advantageous developments of the invention as subject matter.

In claim 8, a guide vane cascade is defined as an object which can be treated independently in each case.

Further details, advantages and features of the invention result from the subsequent description of an exemplary embodiment with reference to the drawing. In the drawing.

Figure 1:
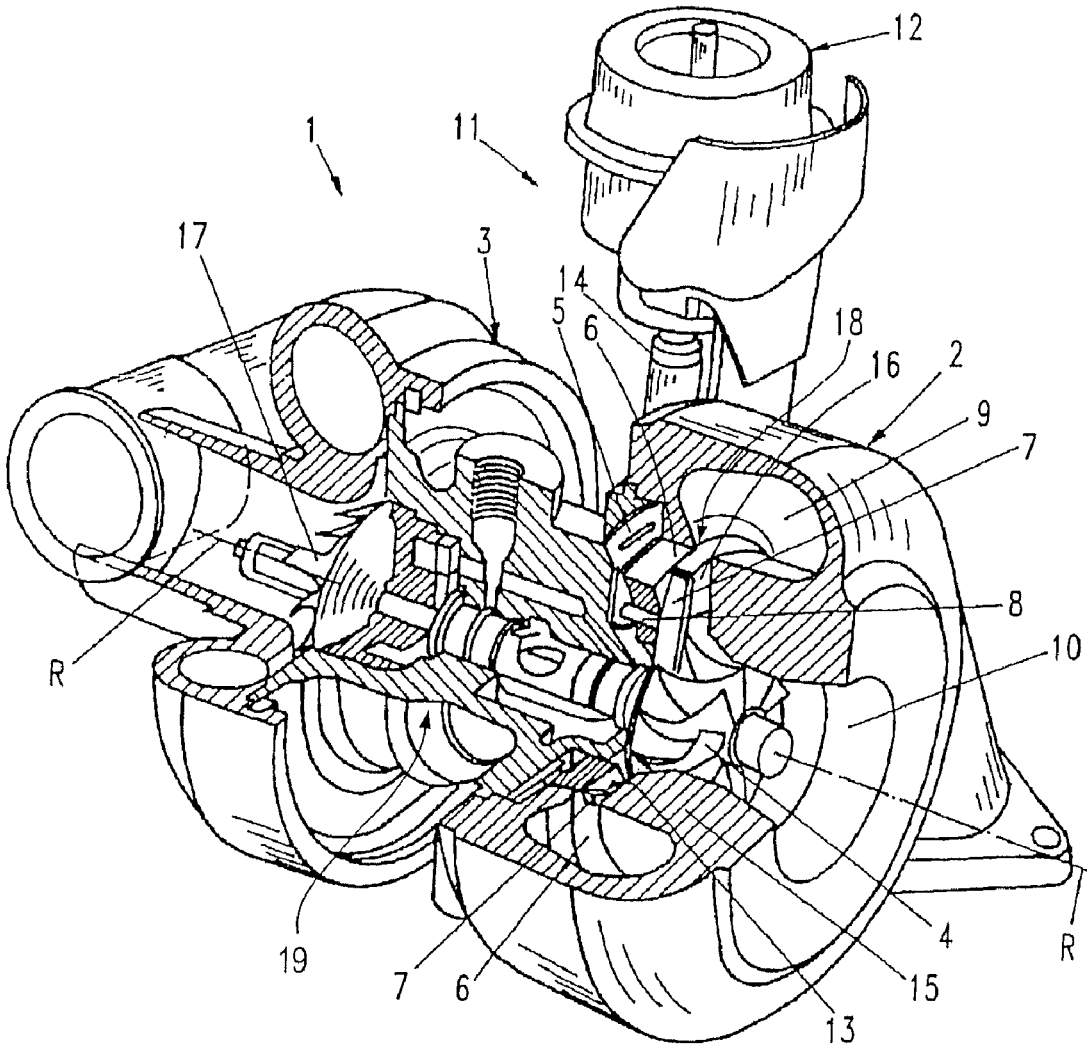
FIG. 1 shows a sectional perspective view of the principle construction of a turbocharger according to the invention.

In FIG. 1, a turbocharger 1 according to the invention is shown, which has a turbine housing 2 and a compressor housing 3 which is connected to it via a bearing housing 19. The housings 2, 3 and 19 are arranged along a rotational axis R. The turbine housing 2 is shown partially in section in order to illustrate the arrangement of a vane bearing ring 6 as part of a radially outer guide vane cascade 18 which has a multiplicity of guide vanes 7, with pivots or vane shafts 8, which are distributed over the circumference. As a result of this, nozzle cross sections are formed which, depending upon the position of the guide vanes 7, are larger or smaller and expose the turbine rotor 4, which is mounted in the middle on the rotational axis R, to a greater or lesser extent to the action of the exhaust gas of an engine which is fed via a feed passage 9 and discharged via a central duct 10 in order to drive a compressor rotor 17, which is seated upon the same shaft, via the turbine rotor 4.

In order to control the movement or the position of the guide vanes 7, an operating device 11 is provided. This can be optionally formed per se, but a preferred embodiment features a control housing 12 which controls the control movement of a ram component 14 which is fastened to it, in order to convert its movement onto an adjusting ring 5, which is located behind the vane bearing ring 6, into a free rotational movement of the adjusting ring. A free space 13 for the guide vanes 7 is formed between the vane bearing ring 6 and an annular section 15 of the turbine housing 2. In order to be able to safeguard this free space 13, the vane bearing ring 6 has spacers 16 which are formed in one piece. In the exemplary case, three spacers 16 are arranged on the circumference of the vane bearing ring 6 with an angular spacing of 120° in each case. In principle, however, it is possible to provide such spacers 16 in a greater or lesser number.

Figure 2:
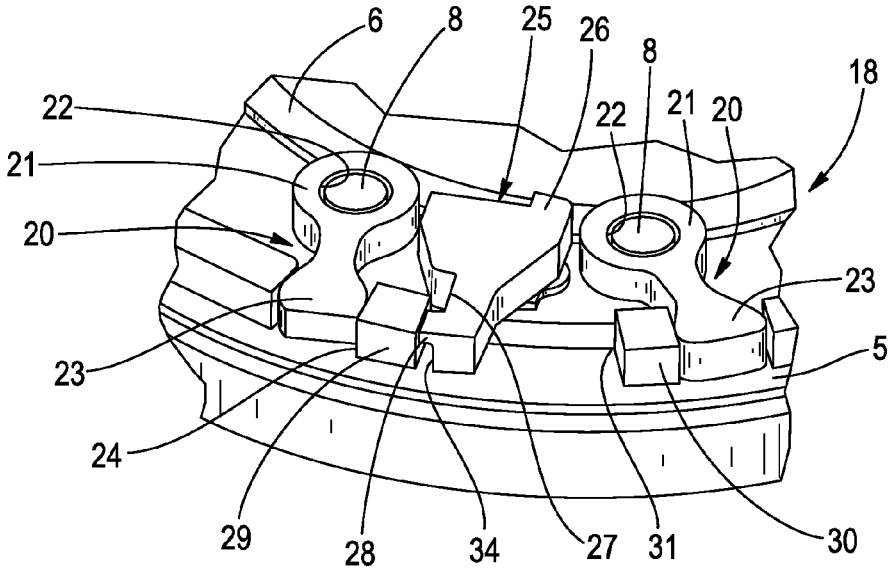
FIG. 2 shows a perspective view of a first embodiment of a guide vane cascade according to the invention.

In FIG. 2, a perspective partial view of a first embodiment of the guide vane cascade 18 according to the invention is shown on an enlarged scale.

A vane lever 20 is shown which is representative for all the vane levers of this guide vane cascade 18 and which at one end has a fastening ring 21 with an opening 22 in which one end of the vane shaft 8 is fixed.

A lever head 23 of the vane lever 20 is arranged in an engagement recess 24 of the adjusting ring 5 and is therefore in engagement with the adjusting ring 5.

Furthermore, FIG. 2 illustrates the arrangement of a stop 25 in the form of a separate component. The stop 25 has a stop body 26 which in the case of the embodiment which is shown has been fixed on the vane bearing ring 6. The stop body 26 has a radially outwardly projecting projection 27 which engages in a slot 31 of the adjusting ring 5. The slot 31 of the adjusting ring 5 is delimited by two stop cams 29 and 30. The stop cams 29 and 30 have stop mating surfaces which point inwards into the slot 31 and can enter into engagement with the corresponding adjacent surface of the projection 27. In the case of the view of FIG. 2, a stop position on the stop cam 29 for adjusting the minimum throughflow through the nozzle cross section of the guide vane cascade 18 is shown.

As FIG. 2 furthermore illustrates, a stop bridge 28 is arranged at the upper end of a side face 34 which points towards the stop cam 29, and extends at right angles to the side face 34. This stop bridge 28 can be aftermachined when required for accurate position adjustment if it should become apparent during the course of the installation of the guide vane cascade 18 that the accurate position still cannot be adjusted. For this purpose, the stop 25 can then be separated from the vane bearing ring 6 and can be aftermachined in a precision device by removing a suitable portion of the stop bridge 28.

Figure 3:
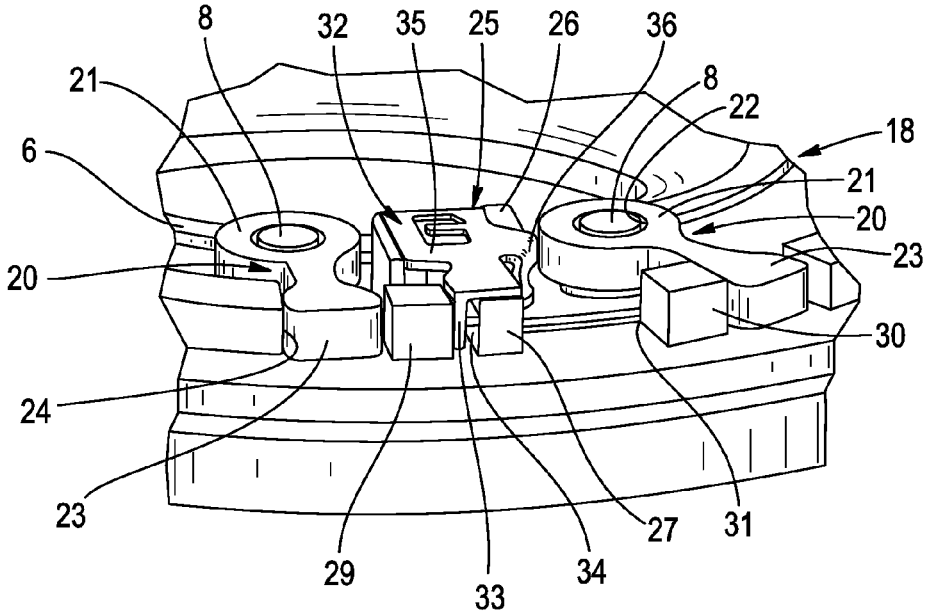
FIG. 3 shows a perspective view, which corresponds to FIG. 2, of a second embodiment of the guide vane cascade according to the invention.

In FIG. 3, a second embodiment of the guide vane cascade 18 according to the invention is shown. In the case of this embodiment, the same parts, which correspond to those of FIG. 2, are provided with the same designations so that the preceding description can be referred to with regard to formation and function.

As opposed to the addition of a stop bridge 28, the stop 25 of the second embodiment is provided with an adjustment plate 32. The adjustment plate 32 has a fixing plate 35 which can be fastened on the stop body 26, such as by means of a fixing clip 36. Naturally, any other types of fastening possibilities for the adjustment plate 32 on the stop body 26 are also conceivable.

Instead of the stop bridge 28, in the case of the second embodiment the adjustment plate 32 is provided with a stop plate 33 which extends parallel to the side face 34 of the projection 27 and occupies a distance to this, which is apparent from FIG. 3, so as to thus be able to define the accurate stop position.

By means of this embodiment, the stop position can consequently be achieved by exchanging the adjustment plate 32 so that an exact adjustment, especially of the minimum throughflow, is also possible in the case of this embodiment in a simple and inexpensive manner.

For supplementing the disclosure, the diagrammatic representation of the invention in FIGS. 1 to 3 is explicitly referred to.

List of Designations

1 Turbocharger
2 Turbine housing
3 Compressor housing
4 Turbine rotor
5 Adjusting ring
6 Vane bearing ring
7 Guide vanes
8 Vane shaft
9 Feed passage
10 Axial duct
11 Operating device
12 Control housing
13 Free space for guide vanes 7
14 Ram component
15 Annular section of the turbine housing 2
16 Spacer/distance Cam
17 Compressor rotor
18 Guide vane cascade/diffuser
19 Bearing housing
20 Vane lever
21 Fastening ring
22 Opening
23 Lever head
24 Engagement recesses
25 Stop
26 Stop body
27 Projection
28 Stop bridge
29, 30 Stop cam
31 Slot
32 Adjustment plate
33 Stop plate
34 Side faces
35 Fixing plate
36 Fixing clip

The invention claimed is:

1. A turbocharger with variable turbine geometry (VTG) comprising:

a turbine housing with a feed passage for exhaust gases;

a turbine rotor, which is rotatably mounted in the turbine housing; and a guide vane cascade, which encloses the turbine rotor radially on the outside, which has a vane bearing ring, which has a multiplicity of guide vanes, each of which has a vane shaft which is mounted in the vane bearing ring, which has an adjusting ring which is in functional communication with the guide vanes via associated vane levers which are fastened by one of their ends on the vane shafts, wherein each vane lever on the other end has a lever head which can be brought into engagement with an associated engagement recess of the adjusting ring, the adjusting ring having an outer peripheral surface, a front face and an end face, the front face facing the vane bearing ring, the end face being opposite the front face and facing away from the vane bearing ring, and which has a stop at least for adjustment of the minimum throughflow between adjacent guide vanes, the stop having an inner end and an outer end, the inner end facing an axis of rotation of the turbine rotor, the outer end being opposite the inner end and facing away from the axis of rotation of the turbine rotor, the stop having a stop body and a projection extending radially outwardly from the stop body, wherein the stop is formed as a separate component which can be fixed in the guide vane cascade and wherein the stop is fixed against rotation on the vane bearing ring and wherein a portion of the projection engages in a slot of the adjusting ring, and wherein at least a substantial portion of the stop body, the projection and the lever heads are located on the end face side of the adjusting ring.

2. The turbocharger as claimed in claim 1, wherein the stop is provided with an adjustment plate.

3. The turbocharger as claimed in claim 2, wherein the adjustment plate is formed as an exchangeable component which is variable in its dimensions and can be fixed on the stop.

4. The turbocharger as claimed in claim 1, wherein the minimum throughflow is adjusted by means of the positioning of vane shaft to vane lever.

5. A guide vane cascade for a turbocharger with variable turbine geometry (VTG), which encloses a turbine rotor of the turbocharger radially on the outside, comprising:

a vane bearing ring, a multiplicity of guide vanes, each of which has a vane shaft which is mounted in the vane bearing ring, an adjusting ring which is in functional communication with the guide vanes via associated vane levers which are fastened by one of their ends on the vane shafts (8), wherein each vane lever on the other end has a lever head which can be brought into engagement with an associated engagement recess of the adjusting ring, the adjusting ring having an outer peripheral surface, a front face and an end face, the front face facing the vane bearing ring, the end face being opposite the front face and facing away from the vane bearing ring, and a stop at least for adjustment of the minimum throughflow between adjacent guide vanes, the stop having an inner end and an outer end, the inner end facing an axis of rotation of the turbine rotor, the outer end being opposite the inner end and facing away from the axis of rotation of the turbine rotor, the stop having a stop body and a projection extending radially outwardly from the stop body, wherein the stop is formed as a separate component which can be fixed in the guide vane cascade and wherein the stop is fixed against rotation on the vane bearing ring and wherein a portion of the projection engages in a slot of the adjusting ring, and wherein at least a substantial portion of the stop body, the projection and the lever heads are located on the end face side of the adjusting ring.

6. The turbocharger as claimed in claim 1, further including a stop bridge that extends generally perpendicularly from a side face of the projection.

7. The turbocharger as claimed in claim 1, wherein the stop further includes an adjustment plate having a fixing plate fastened to the stop body and having a stop plate that extends generally parallel to a side face of the projection.

8. The turbocharger as claimed in claim 1, wherein the stop is asymmetrical.

* * * * *